US009916818B1

(12) United States Patent
Howie

(10) Patent No.: US 9,916,818 B1
(45) Date of Patent: Mar. 13, 2018

(54) NAUTILUS SHELL-SHAPED TONAL MODIFIERS FOR STRINGED INSTRUMENTS

(71) Applicant: Craig Howie, Longmont, CO (US)

(72) Inventor: Craig Howie, Longmont, CO (US)

( * ) Notice: Subject to any disclaimer, the term of this patent is extended or adjusted under 35 U.S.C. 154(b) by 0 days.

(21) Appl. No.: 15/636,665

(22) Filed: Jun. 29, 2017

(51) Int. Cl.

| | |
|---|---|
| ***G10D 3/00*** | (2006.01) |
| ***G10D 1/08*** | (2006.01) |
| ***G10H 3/14*** | (2006.01) |
| ***G10H 3/18*** | (2006.01) |
| ***G10D 3/04*** | (2006.01) |
| ***G10D 3/06*** | (2006.01) |

(52) U.S. Cl.
CPC ..... *G10D 1/08* (2013.01); *G10D 3/04* (2013.01); *G10D 3/06* (2013.01); *G10H 3/143* (2013.01); *G10H 3/18* (2013.01)

(58) Field of Classification Search
CPC .. G10D 3/00; G10D 3/02; G10D 1/00; G10H 1/32; G10H 2220/525; G10F 5/00
See application file for complete search history.

(56) References Cited

U.S. PATENT DOCUMENTS

| | | | | |
|---|---|---|---|---|
| 7,863,507 | B2 | 1/2011 | Ayers | |
| 9,208,756 | B2 * | 12/2015 | Isaac | G10D 1/085 |
| 2009/0013848 | A1 * | 1/2009 | Farnell, Jr. | B29C 44/12 84/291 |
| 2010/0101396 | A1 * | 4/2010 | Ayers | G10D 1/085 84/294 |
| 2014/0345441 | A1 * | 11/2014 | Ostosh | G10D 1/085 84/723 |
| 2015/0101473 | A1 * | 4/2015 | Seal | G10D 3/02 84/291 |
| 2016/0379607 | A1 * | 12/2016 | Austin | G10D 1/005 84/291 |

* cited by examiner

*Primary Examiner* — Marlon Fletcher
(74) *Attorney, Agent, or Firm* — Peter J. Timbers

(57) ABSTRACT

A semi-hollow body of a stringed instrument is claimed the body having nautilus shell-shaped tonal modifiers modified to receive piezo electric pickups. The tonal modifiers generally create a tonal distribution that enhance sound originating from the body cavity of the stringed instrument.

21 Claims, 8 Drawing Sheets

10
8
93a
8
101
4
501
5
201
5
501
402
1
13
8
8
11
6
11
5
401
5
15
7
503
401
7
13
6
202
5
203
2
13
8
502
6
5
402
102
5
83a
502
8
3
502

503
73a
103

9
201
9
501
93b
4
101
501
5
10
402
5
1
401
14
9
6
12
12
5
9
15
12
5
202
14
7
7
203
6
401
2
9
14
5
502
6
103
102
5
83b
402
5
502
3
73b
9
503
9
503

503
502

15
103
67
69e
67e
70e
68
68e
503
66
69
66e
69b
68b
67b
503
70
70b
66b
65
71b
65b
65e
72b
203
64
64b
71
64e
63b
503
71e
62b
61b
73b
60a
63e
63
62e
62

60e
60
61
503
61e

NAUTILUS SHELL-SHAPED TONAL MODIFIERS FOR STRINGED INSTRUMENTS

FIELD OF THE INVENTION

This invention relates generally to an apparatus to modify the tonal distribution of a stringed instrument.

BACKGROUND OF THE INVENTION

In music, there exists a number of ways to modify the tonal sound of any given stringed instrument. A common feature, even in electric guitars, can be a resonant core having a cavity that produces the notes and tones of sound generated by the strings of the instrument. When playing an electric stringed instrument, which has a hollow core or semi-hollow core, the tones are merely defined by the dimensions of the cavity. In one example, U.S. Pat. No. 7,863,507 there exists at least one tuning fork inside the core of a stringed instrument for resonance enhancement. There exists a need to have modification of the tonal distribution in a hollow or semi-hollow body core via other more effective means.

SUMMARY OF THE INVENTION

Accordingly, it is an object of embodiments of the present invention to provide an apparatus that allows for tonal modification of a hollow or semi-hollow body of a stringed instrument. Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the invention comprises a semi-hollow body of a stringed instrument, the semi-hollow body comprising the following: a central core having a core top half and a core bottom half, the core top half having a top half front portion and a top half rear portion, and the core bottom half having a bottom half front portion and a bottom half rear portion; a circumferential wall surrounding the core top half and the core bottom half, the circumferential wall having a circumferential wall face portion and a circumferential wall posterior portion; a longitudinal wall comprising a longitudinal wall face portion and a longitudinal wall posterior portion disposed opposite the longitudinal wall face portion and the longitudinal wall contacting the circumferential wall between the top half rear portion and the bottom half rear portion and the longitudinal wall contacting the circumferential wall between the top half front portion and the bottom half front portion; a face cover having a face cover middle portion, a face cover peripheral portion surrounding the face cover middle portion, a face cover exterior surface and a face cover interior surface, the face cover interior surface proximal to the face cover peripheral portion adapted to attach to the circumferential wall face portion; a posterior cover having a posterior cover middle portion, a posterior cover peripheral portion surrounding the posterior cover middle portion, a posterior cover exterior surface and a posterior cover interior surface, the posterior cover interior surface proximal to the posterior cover peripheral portion adapted to attach to the circumferential wall posterior portion; and an at least one nautilus shell-shaped tonal modifier comprising a nautilus face cap, a nautilus posterior cap, a nautilus side wall between the nautilus face cap and the nautilus posterior cap, a nautilus extension wall, the nautilus extension wall comprised of an nautilus internal wall and a portion of the longitudinal wall, and at least one blade extending from the nautilus to the nautilus sidewall, the at least one blade comprising a blade face surface having a blade face surface area, a blade posterior surface area and a blade edge between the blade face surface and the blade posterior surface.

Benefits and advantages of the present invention include, but are not limited to modifying tones emanating from a stringed instrument to enhance sound quality.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1A:
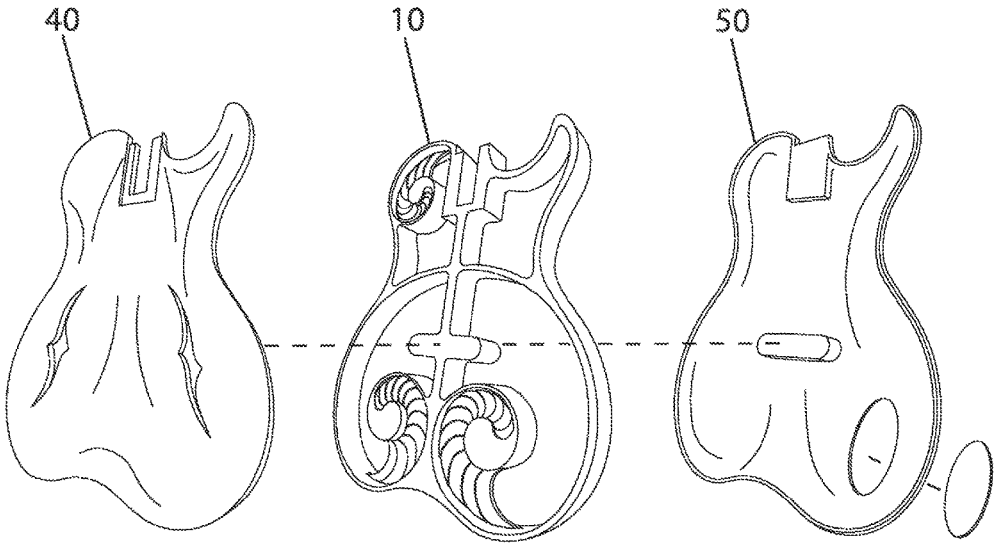
FIG. 1A depicts top side perspective views of the face cover exterior surface, the central core and the posterior cover interior surface in order to demonstrate connectivity of the same.

Reference will now be made in detail to embodiments of the invention, examples of which are illustrated in the accompanying drawings. Throughout the following detailed description, the same reference characters refer to the same or similar elements in all figures.

FIG. 1A depicts an overall picture showing a top side perspective view of the face cover 40, the central core 10 and the posterior cover 50. The dashed lines indicate how the three pieces that comprise the body of the stringed instrument align together.

Figure 1B:
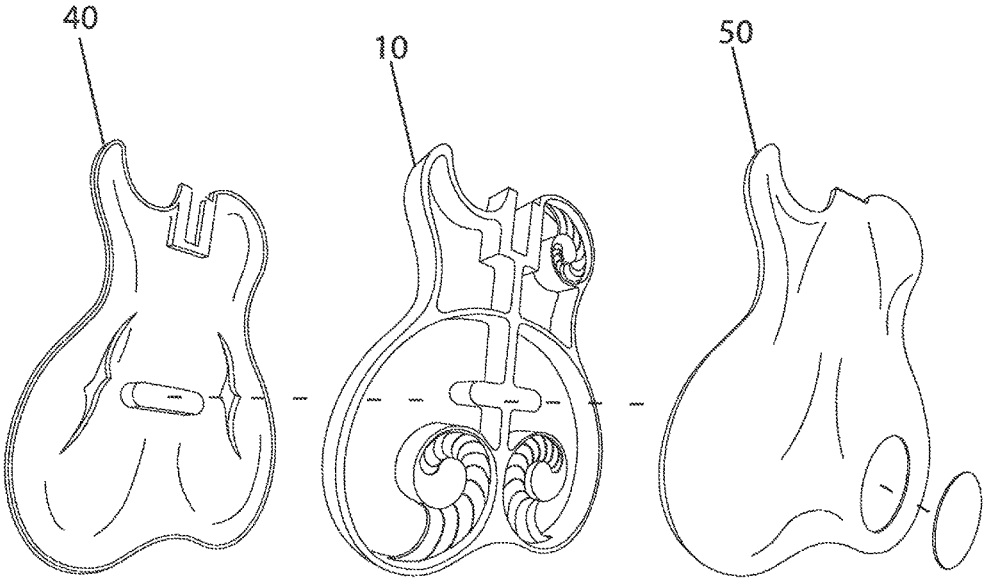
FIG. 1B depicts a bottom perspective side view of the face cover, central core and posterior cover exterior surface in order to demonstrate connectivity of the same.

FIG. 1B depicts an overall picture showing a bottom side perspective view of the face cover 40, the central core 10 and the posterior cover 50. The dashed lines indicate how the three pieces that comprise the body of the stringed instrument are configured and aligned together.

Figure 2A:
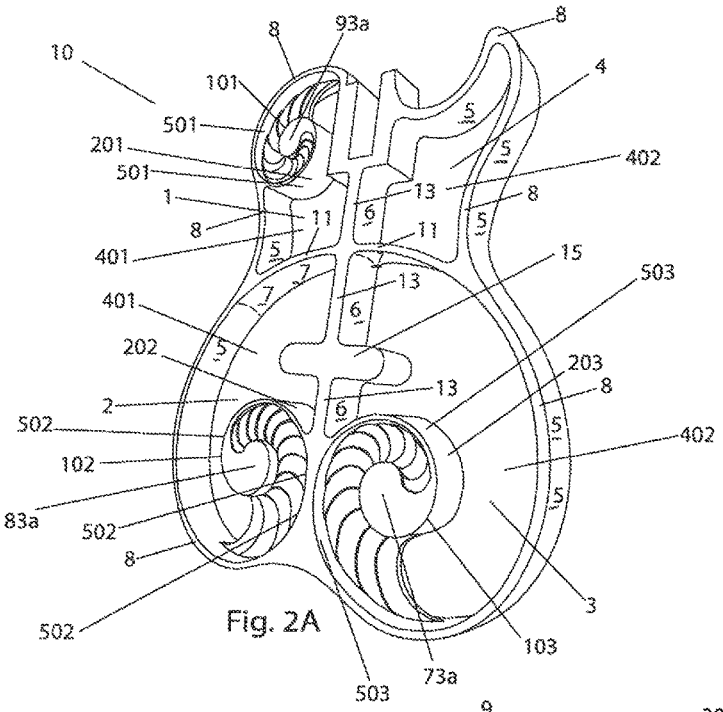
FIG. 2A depicts a top perspective side view of the central core of one embodiment of the instant invention.

FIG. 2A comprises a top side perspective view depiction of the central core 10. The central core 10 comprises a core top half 401 and a core bottom half 402. The core top half 401 comprises a top half front 1 and a top half rear portion 2. The core bottom half 402 comprises a bottom half rear portion 3 and a bottom half front portion 4. A circumferential wall 5 surrounds the core top half 401 and the core bottom half 402.

FIG. 2A depicts the circumferential wall 5 that comprises the circumferential wall face portion 8, which is adaptable to contact the peripheral portion of the face cover peripheral portion (not depicted in FIG. 2A). The circumferential wall posterior portion 9 (not depicted) is opposes the circumferential wall face portion 8.

FIG. 2A further depicts a longitudinal wall 6 having a longitudinal wall face portion 13, which is opposite the longitudinal wall posterior portion 14 (not depicted in FIG. 2A). The longitudinal wall 6 divides the core top half 401 and the core bottom half 402. The longitudinal wall 6 contacts the circumferential wall 5 between the top half rear portion 2 and the bottom half rear portion 3. The longitudinal wall 6 contacts the circumferential wall 5 between the top half front portion 1 and the bottom half front portion 4.

In FIG. 2A, a lateral wall 7 is depicted having a lateral wall face portion 11. The lateral wall face portion 11 is disposed opposite the lateral wall posterior portion 12 (not depicted in FIG. 2A). The lateral wall 7 divides the top half front portion 1 and the top half rear portion 2. The lateral wall 7 also divides the bottom half front portion 4 and the bottom half rear portion 3. The lateral wall 7 contacts the circumferential wall 5 between the top half front portion 1 and the top half rear portion 2. Further, the lateral wall 7 contacts the circumferential wall 5 between the bottom half front portion 4 and the bottom half rear portion 3. In some embodiments of the instant invention, the lateral wall is not included and in other embodiments of the instant invention the lateral wall is included as a feature of the central core 10.

FIG. 2A depicts nautilus shell-shaped tonal modifiers 101, 102, and 103 disposed in the top half front portion 1, the top half rear portion 2 and the bottom half rear portion 3, respectively. FIG. 2A also depicts internal nautilus extension walls 501, 502 and 503 which extend from the nautilus shell-shaped tonal modifiers 101, 102 and 103, respectively. The nautilus extension walls 501, 502, 503 include the nautilus internal walls 201, 202 and 203, respectively. The nautilus extension wall 501 includes the nautilus internal wall 201 and a portion of the circumferential wall 5 located in the top half front portion 1 of the central core 10. The nautilus extension wall 502 includes the nautilus internal wall 202, a portion of the longitudinal wall 6 and a portion of the circumferential wall 5 located in the top half rear portion 2 of the central core 10. In some embodiments of the instant invention, the nautilus extension wall 502 would not comprise the circumferential wall 5 and only comprise a portion of the longitudinal wall 6 and the nautilus internal wall 502. The nautilus extension wall 503 includes the nautilus internal wall 203, a portion of the longitudinal wall 6 and a portion of the circumferential wall 5 located in the bottom half rear portion 3 of the central core 10. In some embodiments of the instant invention, the nautilus extension wall 503 would not comprise the circumferential wall 5 and only comprise a portion of the longitudinal wall 6 and the nautilus internal wall 503.

FIG. 2A depicts a nautilus face cap 73*a* of nautilus shell-shaped tonal modifier 103, nautilus face cap 83*a* of nautilus shell-shaped tonal modifier 102 and nautilus face cap 93*a* of nautilus shell-shaped tonal modifier 101.

FIG. 2A further depicts a core bridge 15 extending into the core top half 401 and into the core bottom half 402. The core bridge 15 is generally aligned perpendicular to and intersecting the longitudinal wall 6. FIG. 2A further depicts a neck slot disposed proximal to the circumferential wall 6 between the top half front portion 1 and the bottom half front portion 4 and adapted to receive the neck of the stringed instrument.

Figure 2B:
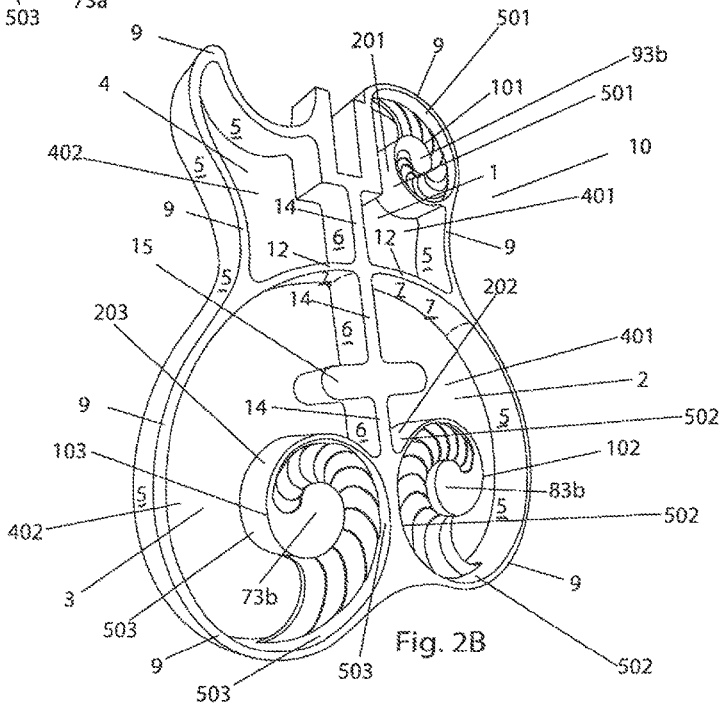
FIG. 2B depicts a bottom side perspective view of the central core of one embodiment of the instant invention.
Figure 3A:
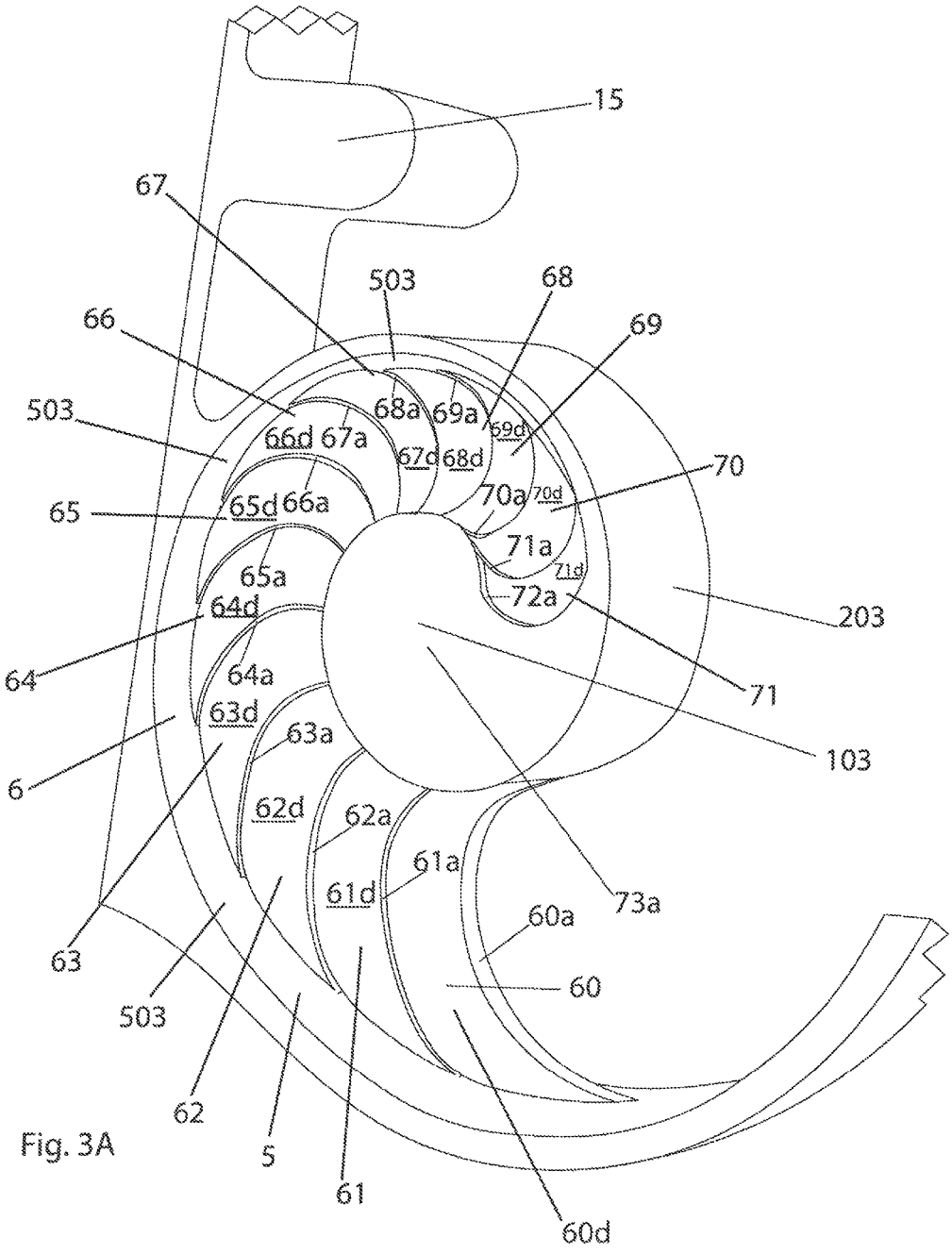
FIG. 3A depicts a top side perspective view of nautilus shell-shaped tonal modifier in one embodiment of the present invention.

FIG. 2B comprises a bottom side perspective view depiction of the central core 10. The features and elements are nearly identical to what is depicted in FIG. 2A. However, FIG. 2B depicts the circumferential wall posterior portion 9 opposing the circumferential wall face portion 8 as shown previously in FIG. 2A. FIG. 2B depicts the longitudinal wall posterior portion 14 opposing the longitudinal wall face portion as shown previously in FIG. 2A. FIG. 2B depicts the lateral wall posterior portion 12 opposing the lateral wall face portion 11 previously in FIG. 2A. Similarly, FIG. 2B depicts a nautilus posterior cap 73*b* of nautilus shell-shaped tonal modifier 103, nautilus posterior cap 83*b* of nautilus shell-shaped tonal modifier 102 and nautilus posterior cap 93*b* of nautilus shell-shaped tonal modifier 101. The nautilus face caps of the nautilus shell-shaped tonal modifiers of FIG. 2A are on opposing sides of the nautilus shell-shaped tonal modifiers of the nautilus posterior caps of FIG. 2B FIG. 3A is a top side perspective view of the nautilus shell-shaped tonal modifier 103 of the bottom half rear portion 3 of the central core 10 as depicted in FIG. 2A. FIG. 3A depicts the nautilus shell-shaped tonal modifier 103 having a nautilus extension wall 503 extending from the nautilus shell-shaped modifier 103. The nautilus extension wall 503 comprises the nautilus internal wall 203 and the nautilus extension wall 503 further comprises the longitudinal wall 6 and, still further, the nautilus extension wall comprises the circumferential wall 5 in the bottom half rear portion 3 of the central core 10.

FIG. 3A depicts a first blade 60 having a first blade edge 60*a*, a first blade face surface area 60*d* and the first blade 60 extends from the nautilus side wall (not numbered in the FIG. 3A depiction) of the nautilus shell-shaped tonal modifier 103 to the nautilus extension wall 503. A second blade 61 having a second blade edge 61*a*, a second blade face surface area 61*d* and the second blade 61 extends from the nautilus side wall of the nautilus shell-shaped tonal modifier 103 to the nautilus extension wall 503 and the second blade 61 starts to form a spiral relative to the first blade 60 around the nautilus shell-shaped tonal modifier 103. A third blade 62 having a third blade edge 62*a*, a third blade face surface area 62*d* and the third blade 62 extends from the nautilus side wall of the nautilus shell-shaped tonal modifier 103 to the nautilus extension wall 503 and the third blade 62 continues to form a spiral relative to the second blade 61 around the nautilus shell-shaped tonal modifier 103. This pattern of a plurality of blades each having a blade face surface area next to a similar blade with blade face surface area and a blade edge in between the blades and the blade surface areas ascend upward in a step-like manner and continues until the last blade and blade surface area is next to the nautilus face surface cap. The plurality of blades spirally extends and ascends in layers with each successive blade in contact with the nautilus shell-shaped tonal modifier and the nautilus extension wall and continues spirally ascending until the ascension reaches the nautilus face cap. The successive blade face surface areas decrease as the blades ascend from the first blade to the last blade before the nautilus face cap. In many embodiments of the instant invention, the ascending blade edges are curved and the first blade is curved.

Figure 3B:
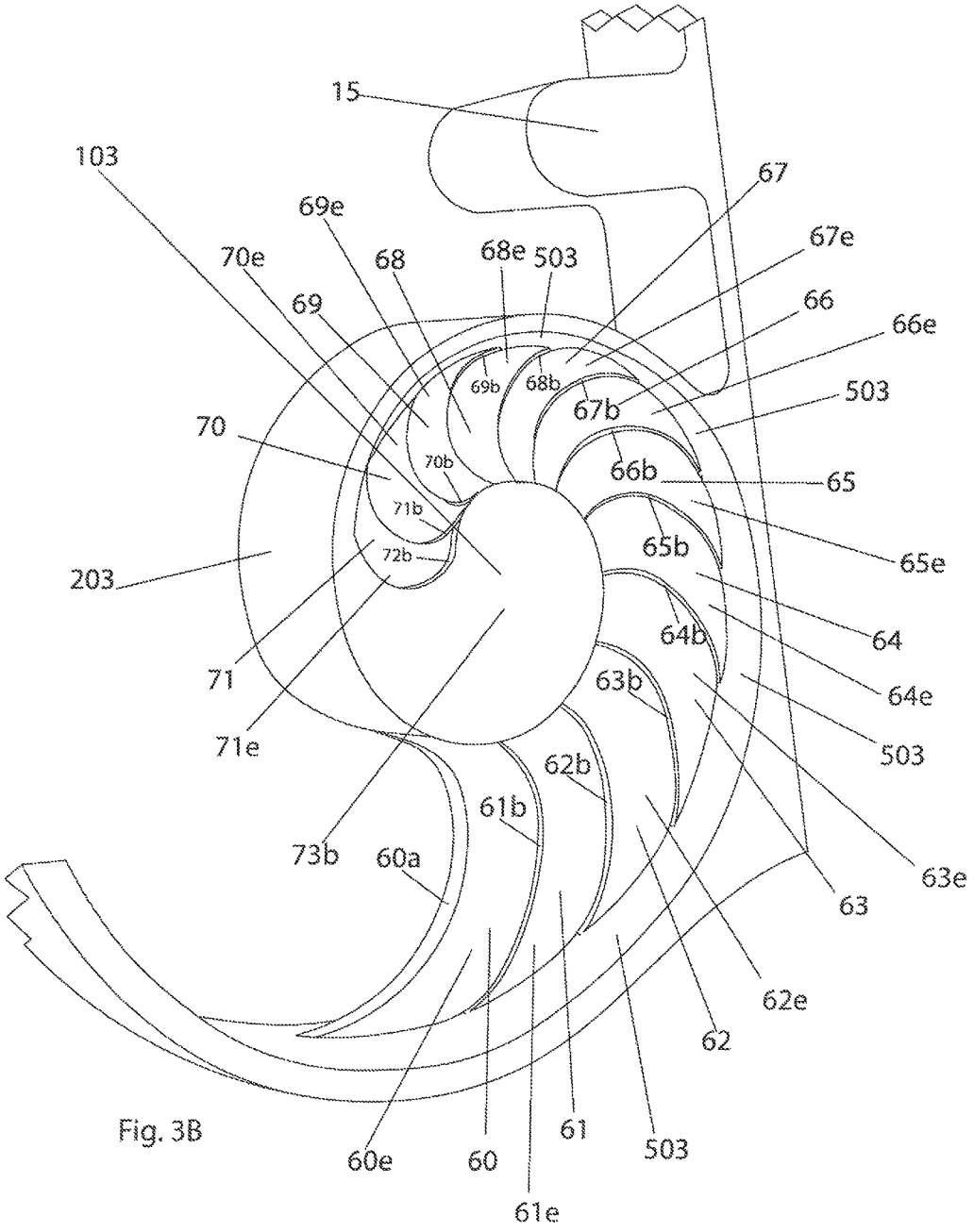
FIG. 3B depicts a bottom side perspective view of a nautilus shell-shaped tonal modifier in one embodiment of the present invention.

FIG. 3B depicts a first blade 60 having a first blade edge 60*b*, a first blade posterior surface area 60*e* and the first blade 60 extends from the nautilus side wall (not numbered in the FIG. 3B depiction) of the nautilus shell-shaped tonal modifier 103 to the nautilus extension wall 503. A second blade 61 having a second blade edge 61*b*, a second blade posterior surface area 61*e* and the second blade 61 extends from the nautilus side wall of the nautilus shell-shaped tonal modifier 103 to the nautilus extension wall 503 and the second blade 61 starts to form a spiral relative to the first blade 60 around the nautilus shell-shaped tonal modifier 103. A third blade 62 having a third blade edge 62*b*, a third blade posterior surface area 62*e* and the third blade 62 extends from the nautilus side wall of the nautilus shell-shaped tonal modifier 103 to the nautilus extension wall 503 and the third blade 62 continues to form a spiral relative to the second blade around the nautilus shell-shaped tonal modifier 103. This pattern of a plurality of blades each having a blade posterior surface area next to a similar blade with blade posterior surface area and a blade edge in between the blades and the blade posterior surface areas descend downward in a step-like manner and continues until the last blade and blade posterior surface is next to the nautilus posterior surface cap. The plurality of blades spirally extends and descends with each successive blade in contact with the nautilus shell-shaped tonal modifier and the nautilus extension wall and continues spirally descending in layers until the dissension reaches the nautilus posterior cap. The successive blade posterior surface areas decrease as the blades descend from the first blade to the last blade before the nautilus face cap. In many embodiments of the present invention, the spirally ascending blades form a mirror image of the spirally descending blades. In other embodiments, the nautilus shell-shape tonal modifier comprises only a spirally descending stair-like arrangement of descending blades. In still other embodiments, the nautilus shell-shape tonal modifier comprises only a spirally ascending stair-like arrangement of ascending blades. In many embodiments of the instant invention, the descending blade edges are curved and the first blade is curved.

Figure 3C:
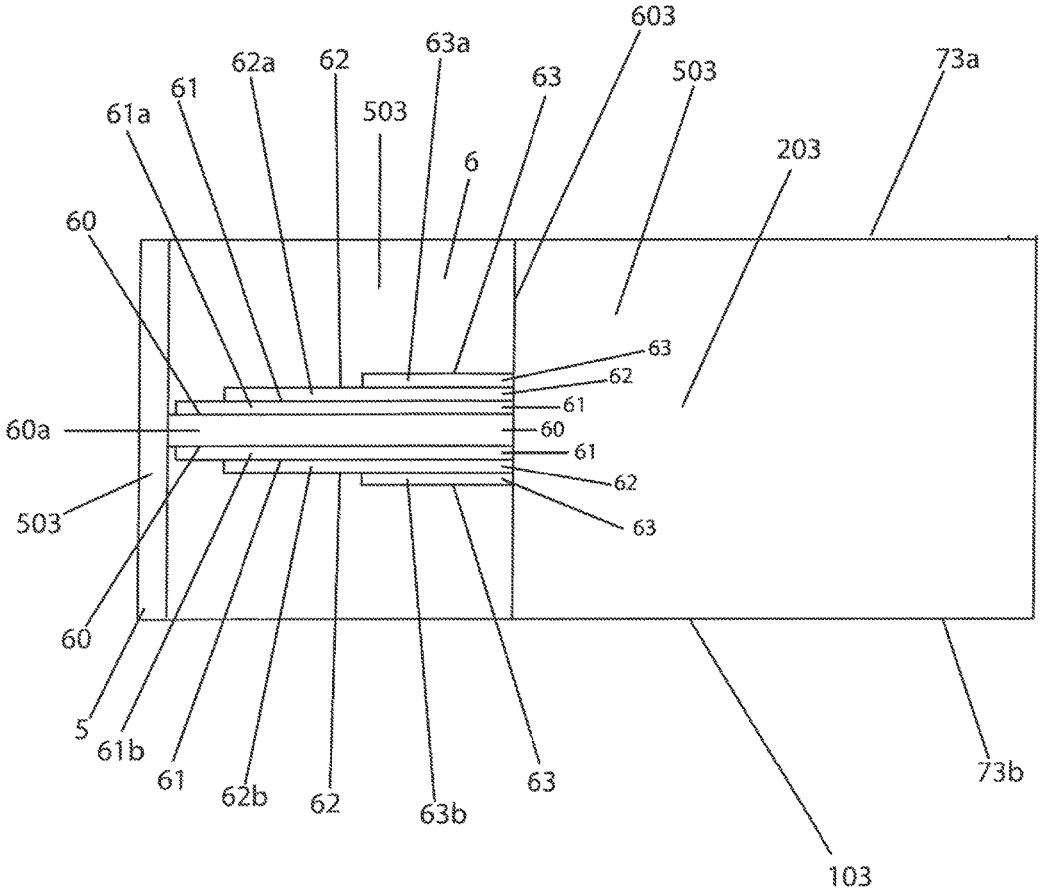
FIG. 3C depicts a cross section view of a nautilus shell-shaped tonal modifier from a perspective inside the bottom half rear portion looking toward the nautilus and depicting the first, second, third and fourth blades in both a descending and an ascending stair step-like manner.

FIG. 3C is cross sectional view of the nautilus shell-shaped as viewed from inside the circumferential wall of the bottom half rear portion 3 of the central core 10. The nautilus shell-shaped tonal modifier 103 comprises the nautilus face cap 73*a*, a nautilus posterior cap 73*b*, a nautilus side wall 603 between the nautilus face cap 73*a* and the nautilus posterior cap 73*b*. FIG. 3C depicts the nautilus extension wall 503. In the embodiment depicted in FIG. 3C, the nautilus extension wall 503 includes a portion of the circumferential wall 5, the longitudinal wall 6 and the nautilus internal wall 203.

FIG. 3C depicts the first blade 60 having a first blade edge 60*a*, a second ascending blade edge 61*a* above the first blade edge 60*a* and a second descending blade edge 61*b* below the first blade edge 60*a*, a third ascending blade edge 62*a* above the second ascending blade edge 61*b* and a third descending blade edge 62*b* below the second descending blade edge 61*b*, a fourth ascending blade edge 63*a* above the third ascending blade edge 62*a* and a fourth descending blade edge 63*b* below third descending blade edge 62*b*, a fifth ascending blade edge 64*a* above the fourth ascending blade edge 63*a* and a fifth descending blade edge 64*b* below fourth descending blade edge 63*b*. The nautilus extension wall 503 comprises a nautilus internal wall 203, a portion of the longitudinal wall 6 and a portion of the circumferential wall 5. The blades extend from the nautilus sidewall 603 of the nautilus shell-shaped tonal modifier 103 to the nautilus extension wall. The at least one blade comprising a blade face surface having a blade face surface area, a blade posterior surface area and a blade edge between the blade face surface areas and the blade posterior surface areas.

Figure 3D:
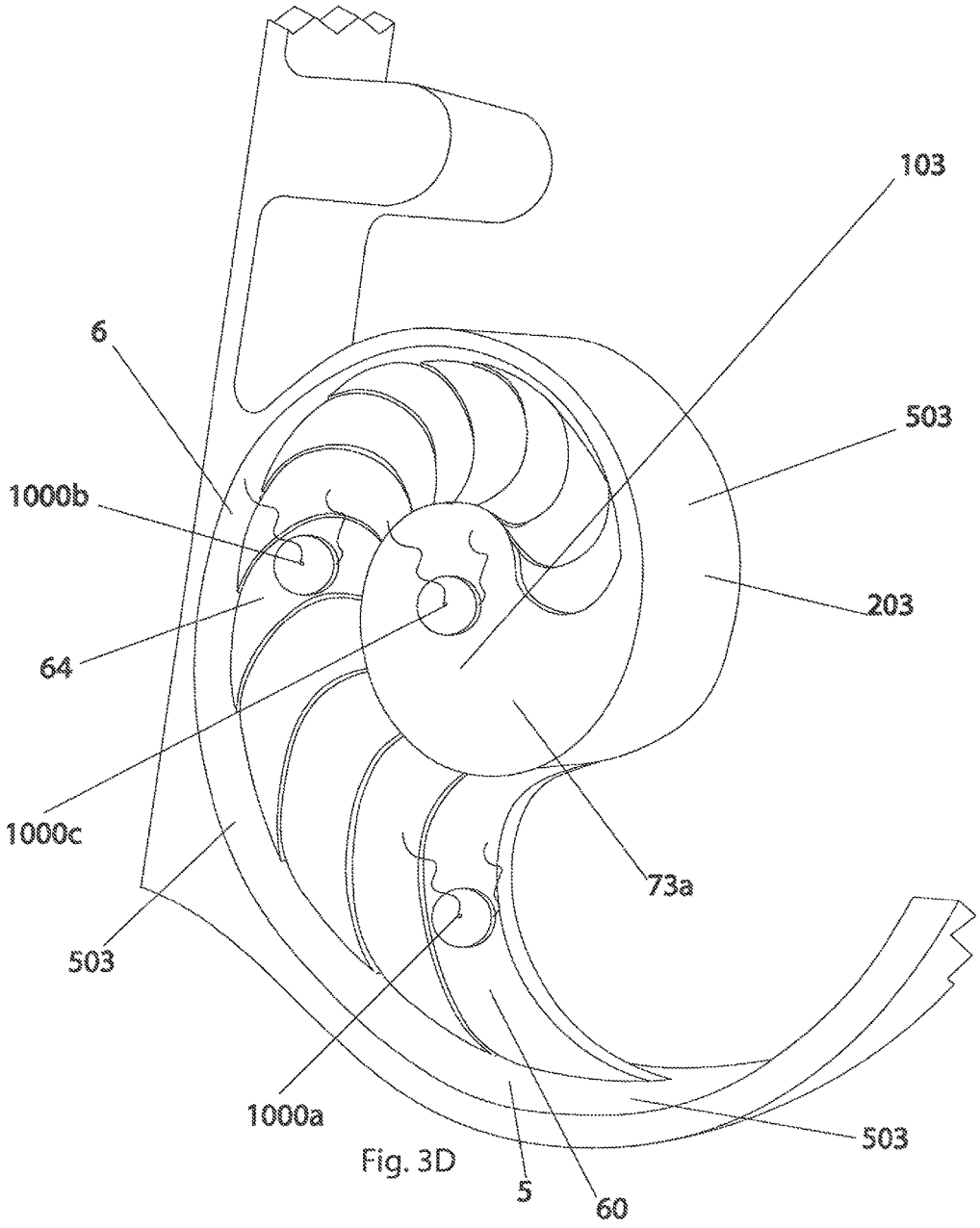
FIG. 3D depicts a top side perspective of a nautilus shell-shaped tonal modifier with piezo electric pick-ups.

FIG. 3D depicts the nautilus shell-shaped tonal modifier 103 adapted to receive at least one piezo electric pickup. FIG. 3D depicts the nautilus cap 73*a* having received one piezo electric pickup 1000*c*, the first blade 60 having received another piezo electric pickup 1000*a* and one of the plurality of ascending blades having received another piezo electric pickup 1000*b*. It is fully contemplated within the scope of this invention that the piezo electric pickups could be placed on either ascending or descending blade surface areas and anywhere on the nautilus shell-shaped tonal modifier.

Although not depicted, it is intended and within the scope of this invention that the nautilus shell-shape tonal modifier configuration described in FIGS. 3A, 3B and 3C of the bottom half rear portion 3 is mirrored in the nautilus shell-shape tonal modifier configuration of the top half rear portion 2 as depicted in FIGS. 2A and 2B. In another embodiment of the instant invention, the nautilus shell-shaped tonal modifier configuration in the top half front portion 1 would be similarly structured as the nautilus shell-shaped tonal modifiers disposed in the top and bottom rear portions with the exception being that the nautilus extension wall in the top half front portion 1 comprises an internal wall and a portion of the circumferential wall.

Figure 4A:
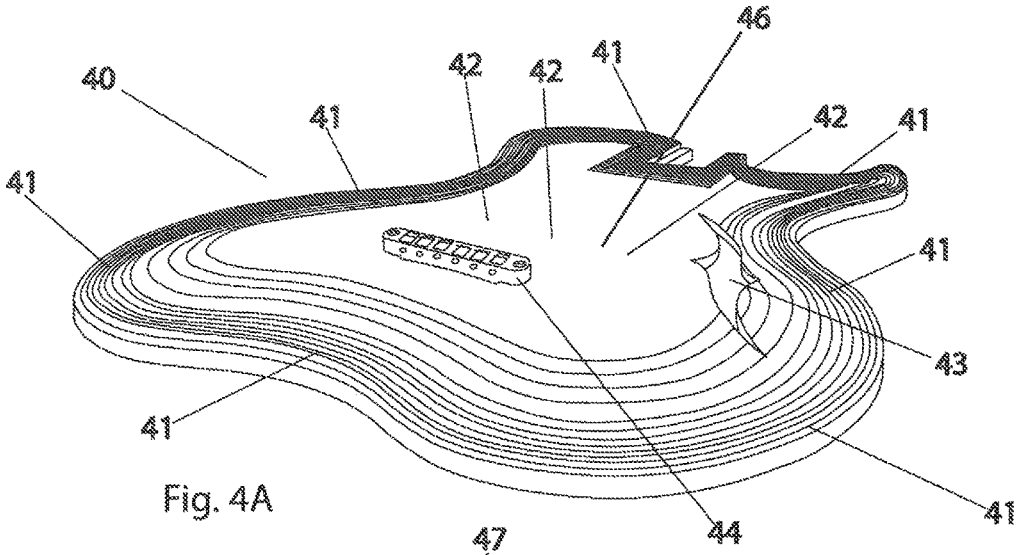
FIG. 4A depicts a top side perspective view of the face cover exterior surface of the face cover of one embodiment of the instant invention.

FIG. 4A depicts a top side perspective view the face cover 40 having a face cover middle portion 42, a face cover peripheral portion 41 surrounding the face cover middle portion 42. The face cover 40 further comprises a face cover exterior surface 46. The face cover exterior surface 46 further comprises a string bridge 44 adapted to receive and attach strings of the stringed instrument. The string bridge 44 is disposed on the face cover middle portion 42.

Figure 4B:
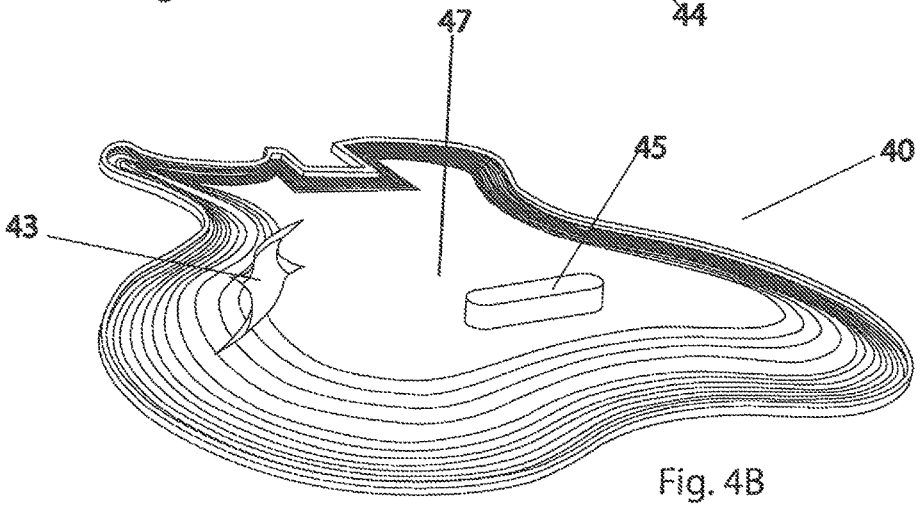
FIG. 4B depicts a bottom side perspective view of the face cover interior surface of the face cover of one embodiment of the instant invention.

FIG. 4B depicts a bottom side perspective view of the face cover 40 having an interior surface 47. The face cover internal surface 47 further comprises a face cover internal bridge 15 extender 45 contacting the core bridge (not depicted in this FIG. 4B). The face cover interior surface 47 proximal to the face cover peripheral portion 41 is adaptable to be attached to the circumferential wall face portion 8.

Figure 4C:
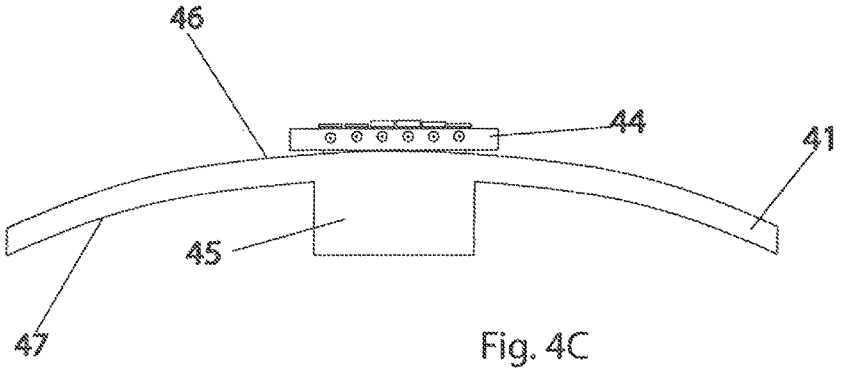
FIG. 4C depicts a cross sectional view of the face cover showing the face cover middle portion and the face cover peripheral portion of one embodiment of the instant invention.

FIG. 4C depicts a cross sectional view of face cover. This view shows face cover interior surface 47 comprising a concave shape and the face cover exterior surface 46 comprising a convex shape. The string bridge 44 is generally disposed opposite to the face cover internal bridge 45.

Figure 5A:
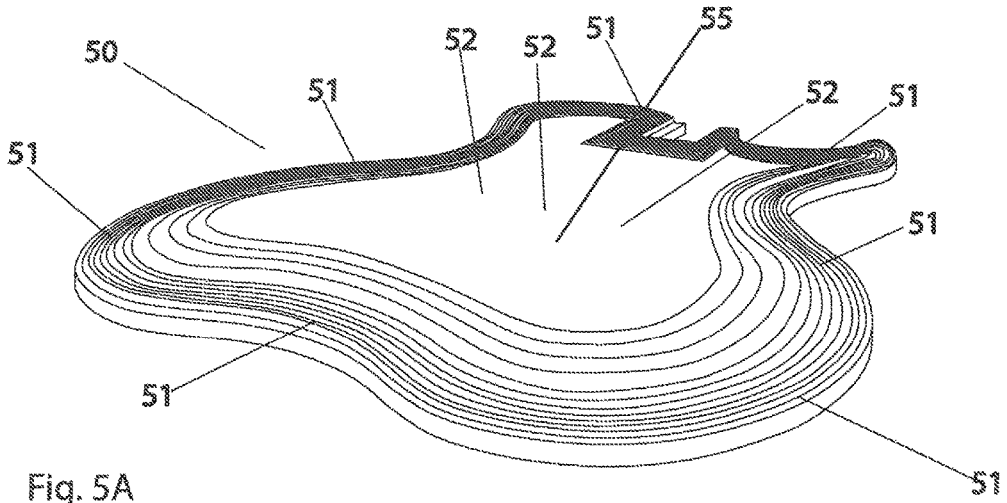
FIG. 5A depicts a bottom side perspective view of the posterior cover exterior surface of the posterior cover of one embodiment of the instant invention.

FIG. 5A depicts a top side perspective view the posterior cover 50 having a posterior cover middle portion 52, a posterior cover peripheral portion 51 surrounding the posterior cover middle portion 52. The posterior cover 50 further comprises a posterior cover exterior surface 55.

Figure 5B:
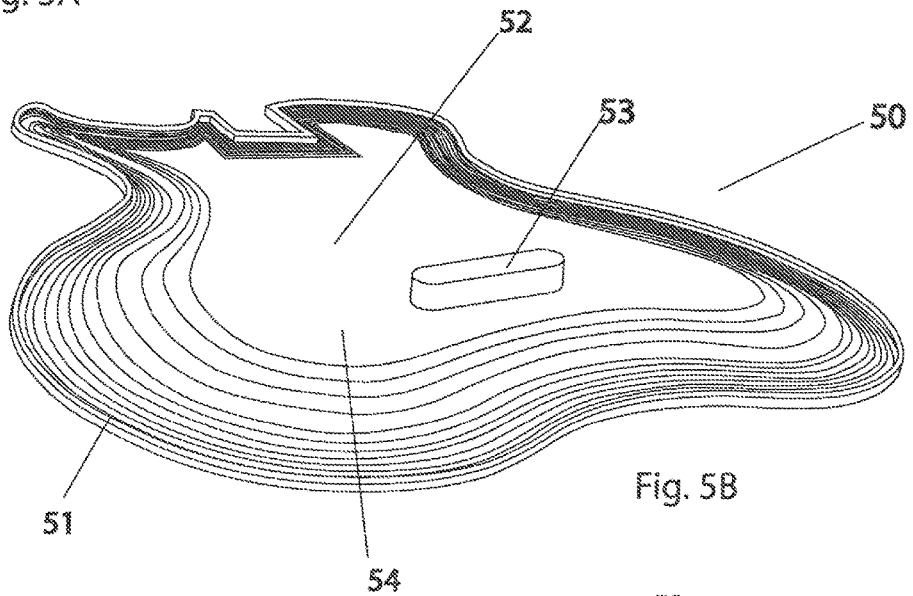
FIG. 5B depicts a bottom side perspective view of the posterior cover interior surface of the posterior cover of one embodiment of the instant invention.

FIG. 5B depicts a bottom side perspective view of the posterior cover 50 having a posterior cover interior surface 54, a posterior peripheral portion 51 and a posterior portion middle portion 52. The posterior internal surface 54 is adaptable to contact with the circumferential wall posterior portion 9 (not depicted). The posterior cover interior surface 54 further comprises a posterior cover internal bridge extender 53 adaptable to contact the core bridge 15 (not depicted).

Figure 5C:
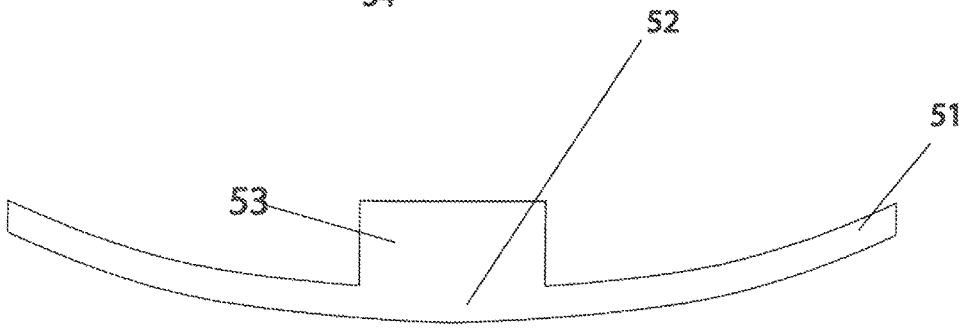
FIG. 5C depicts a cross sectional view of the posterior cover showing the posterior cover middle portion and the posterior cover peripheral portion.

FIG. 5C depicts a cross sectional view of posterior cover 50. This view shows posterior cover medial portion 52, the posterior cover peripheral portion 51 and the posterior cover internal bridge extender 53 attached to the posterior cover of the interior surface 54. This cross section depiction of FIG. 5C shows that the posterior cover exterior surface 55 is generally a convex shape and the posterior cover interior surface 44 comprises a concave shape.

While the semi-hollow body of the stringed instrument described herein has depicted a hollow electric guitar, or a semi hollow electric guitar, it is understood that the claimed invention is for stringed instruments selected from the group consisting of electric guitars, hollow electric guitars, electric semi-hollow guitars, acoustic guitars ukuleles, mandolins, basses, electric bases, electric bass guitars.

It is believed that the apparatus of the present invention and many of its attendant advantages will be understood from the foregoing description. It is also believed that it will be apparent that various changes may be made in the form, geometry, construction, and arrangement of the components without departing from the scope and spirit of the invention and without sacrificing its material advantages. The forms described are merely exemplary and explanatory embodiments thereof. It is the intention of the following claims to encompass and include such changes.

What is claimed is:

1. A semi-hollow body of a stringed instrument, the semi-hollow body comprising:

a central core having a core top half and a core bottom half, the core top half having a top half front portion and a top half rear portion, and the core bottom half having a bottom half front portion and a bottom half rear portion;

a circumferential wall surrounding the core top half and the core bottom half, the circumferential wall having a circumferential wall face portion and a circumferential wall posterior portion;

a longitudinal wall comprising a longitudinal wall face portion and a longitudinal wall posterior portion disposed opposite the longitudinal wall face portion and the longitudinal wall contacting the circumferential wall between the top half rear portion and the bottom half rear portion and the longitudinal wall contacting the circumferential wall between the top half front portion and the bottom half front portion;

a face cover having a face cover middle portion, a face cover peripheral portion surrounding the face cover middle portion, a face cover exterior surface and a face cover interior surface, the face cover interior surface proximal to the face cover peripheral portion attaching to the circumferential wall face portion;

a posterior cover having a posterior cover middle portion, a posterior cover peripheral portion surrounding the posterior cover middle portion, a posterior cover exterior surface and a posterior cover interior surface, the posterior cover interior surface proximal to the posterior cover peripheral portion attaching to the circumferential wall posterior portion; and an at least one nautilus shell-shaped tonal modifier comprising a nautilus face cap, a nautilus posterior cap, a nautilus side wall between the nautilus face cap and the nautilus posterior cap, a nautilus extension wall, the nautilus extension wall comprised of a nautilus internal wall and a portion of the longitudinal wall, and at least one blade extending from the nautilus to the nautilus sidewall, the at least one blade comprising a blade face surface having a blade face surface area, a blade posterior surface area and a blade edge between the blade face surface and the blade posterior surface.

2. The semi-hollow body of the stringed instrument of claim 1, further comprising a lateral wall having a lateral wall face portion and a lateral wall posterior portion disposed opposite the lateral wall face portion, the lateral wall contacting the core top half between the top half front portion and the top half rear portion, and the lateral wall contacting the core bottom half between the bottom half front portion and the bottom half rear portion.

3. The semi-hollow body of the stringed instrument of claim 1, wherein the at least one tonal modifier is disposed in the top half rear portion of the core top half.

4. The semi-hollow body of the stringed instrument of claim 3, wherein the nautilus extension wall further comprises a portion of the circumferential wall surrounding the top half rear portion of the core top half.

5. The semi-hollow body of the stringed instrument of claim 1, wherein the at least one tonal modifier is disposed in the bottom half rear portion of the core bottom half.

6. The semi-hollow body of the stringed instrument of claim 5, wherein the nautilus extension wall further comprises a portion of the circumferential wall surrounding the bottom half rear portion of the core bottom half.

7. The semi-hollow body of the stringed instrument of claim 1, wherein the at least one nautilus shell-shaped tonal modifier further comprises a first blade and a plurality of successive upward blades spirally extending from the nautilus to the nautilus sidewall and layered above the first blade in a step-like manner from the first blade until flush with the nautilus face cap.

8. The semi-hollow body of the stringed instrument of claim 6, wherein the first blade comprises a largest blade face surface area and each blade face surface area of the plurality of successive upward blades comprises a decreasing blade face surface area.

9. The semi-hollow body of the stringed instrument of claim 1, wherein the at least one nautilus shell-shaped tonal modifier further comprises a first blade and a plurality of successive downward blades spirally extending from the nautilus to the nautilus sidewall and layered below the first blade in a step-like manner from the first blade until flush with the nautilus posterior cap.

10. The semi-hollow body of the stringed instrument of claim 8, wherein the first blade comprises a largest blade posterior surface area and each blade face surface area of the plurality of successive downward blades comprises a decreasing blade posterior surface area.

11. The semi-hollow body of the stringed instrument of claim 1, wherein the at least one blade edges are curved.

12. The semi-hollow body of the stringed instrument of claim 1, wherein the at least one nautilus shell-shaped tonal modifier is adapted to receive an at least one piezo electric pickup.

13. The semi-hollow body of the stringed instrument of claim 1, wherein the face cover interior surface comprises a concave shape and the face cover exterior surface comprises a convex shape.

14. The semi-hollow body of the stringed instrument of claim 1, wherein the posterior cover exterior surface comprises a convex shape and the posterior cover interior surface comprises a concave shape.

15. The semi-hollow body of the stringed instrument of claim 1, further comprising a core bridge extending into the core top half and into the core bottom half and the core bridge perpendicularly intersecting the longitudinal wall.

16. The semi-hollow body of the stringed instrument of claim 14, wherein the face cover internal surface further comprises a face cover internal bridge extender contacting the core bridge.

17. The semi-hollow body of the stringed instrument of claim 15, further comprising a string bridge adapted to receive and attach strings of the stringed instrument, the string bridge disposed on the face cover external surface and the string bridge generally disposed opposite to the face cover internal bridge.

18. The semi-hollow body of the stringed instrument of claim 14, wherein the posterior cover internal surface further comprising a posterior cover internal bridge extender contacting the core bridge.

19. The semi-hollow body of the stringed instrument of claim 1, further comprising a neck slot disposed proximal to the circumferential wall between the top half front portion and the bottom half front portion and adapted to receive the neck of the stringed instrument.

20. The semi-hollow body of the stringed instrument of claim 1, wherein the stringed instrument is an instrument selected from the group consisting of electric guitars, hollow electric guitars, electric semi-hollow guitars, acoustic guitars ukuleles, mandolins, basses, electric bases, electric bass guitars.

21. The semi-hollow body of the stringed instrument of claim 1, wherein the at least one tonal modifier is disposed in the top half front portion and the nautilus extension wall further comprises a portion of the circumferential wall proximal to the top half front portion and does not comprise a portion of the longitudinal wall.

* * * * *